United States Patent [19]

Jones, Jr. et al.

[11] 4,116,810

[45] Sep. 26, 1978

[54] INDIRECT HEATING PYROLYSIS OF OIL SHALE

[75] Inventors: John B. Jones, Jr.; Adam A. Reeves, both of Grand Junction, Colo.

[73] Assignee: Paraho Corporation, Grand Junction, Colo.

[21] Appl. No.: 689,505

[22] Filed: May 24, 1976

[51] Int. Cl.[2] ..... C10G 1/02

[52] U.S. Cl. ..... 208/11 R; 48/89; 48/119; 201/34; 201/43

[58] Field of Search ..... 208/11 R; 201/34, 36, 201/43

[56] References Cited

U.S. PATENT DOCUMENTS

| | | | |
|---|---|---|---|
| 2,812,288 | 11/1957 | Lankford et al. | 208/11 R |
| 3,841,992 | 10/1974 | Jones et al. | 208/11 R |
| 3,887,453 | 6/1975 | Ueta et al. | 208/11 R |

*Primary Examiner*—Herbert Levine
*Attorney, Agent, or Firm*—Richard D. Law

[57] ABSTRACT

Hot, non-oxygenous gas at carefully controlled quantities and at predetermined depths in a bed of lump oil shale provides pyrolysis of the contained kerogen of the oil shale, and cool non-oxygenous gas is passed up through the bed to conserve the heat inventory for a viable process. The bed being fed at the top with raw shale and retorted shale being removed at the bottom provides a constant depth, continuously moving bed of shale, for a continuous process.

5 Claims, 4 Drawing Figures

INDIRECT HEATING PYROLYSIS OF OIL SHALE

This invention resulted from work done under Lease Agreement dated May 11, 1972, between the United States (represented by Honorable Rogers C.B. Morton, Secretary of the Interior) and Development Engineering, Incorporated.

Oil shale, i.e., a rock or mineral commonly called an oil shale, is found in many parts of the world, with substantial beds of the "oil shale" particularly in Colorado, Utah and Wyoming. Small size commercial operations for recovering oil from the oil shale have been carried out in many countries of the world, including the United States. However, currently there are apparently no large commercial plants in the United States. With the depletion of easy available petroleum, a substantial amount of research has been done for the recovery of shale oil from the oil shale.

Shale oil is not a naturally occuring product in the oil shale, and to produce shale oil from the rock, it is subjected to a pyrolysis. The organic matter (called kerogen) in the oil shale is converted to some permanent gas, some condensable gas, and a liquid called shale oil. In the rock, the organic material has limited solubility in ordinary solvents, but upon strong heating, a shale oil is formed which resembles petroleum in some respects. Shale oil from various sources may be quite different in properties, and two major factors affecting the differences are the oil shale source and the method of processing the rock to product the oil.

It is known that a temperature on the order of slightly over 900° F. is necessary to convert the organic material of the rock to oil. As the temperature of pyrolysis increases, however, considerable differences may occur in the shale oil. For economic considerations, however, it would appear to be desireable to maintain the pyrolysis temperature as low as necessary to produce oil and to convert substantially all of the organic material to oil or gas. The lower temperature, also, reduces the inorganic carbonate degradation.

The pyrolysis of the organic material in oil shale, in its fundamental aspects, appears to be a relatively simple operation. The process involves heating the shale to a proper temperature and recovering the products which are emitted from the shale. In practical application, however, this apparently simple operation has not been achieved in a large scale commercial application, even though dozens of types of processes and literally hundreds of types of equipment have been devised for the oil shale retorting. In one general method, oil shale is mined, reduced to relatively small particles fed to a kiln where it is heated to a temperature necessary to produce the required pyrolysis. The pyrolysis, generally, produces a mist of liquid droplets and various gases which are withdrawn from the particulate shale. The retorted shale is subsequently discarded. One effective type of retorting vessel is a vertical, shaft kiln, such as shown in the U.S. Pat. No2. 3,736,247, patented May 29, 1973, 2,757,129, patented July 31, 1956, 2,901,402, patented Aug. 25, 1969, among many others.

From a practical consideration, an effective oil shale retorting process has been achieved in a shaft kiln by a gravity flow, continuously moving shale bed in the kiln. The constant height bed is produced by feeding solids to the top of the bed and withdrawing solids from the bottom to maintain the uniform depth of the bed. The retort includes essentially three vertically aligned zones namely, a top preheating zone for the shale (which, also, provides for the disengagement of the products of the pyrolysis from the raw shells) a mid zone for pyrolysis, and a lower cooling zone below the pyrolysis zone. This process utilizes incoming ambient temperature solids to cool the rising stream of the produced products from the pyrolysis, so that the products stream leave the bed at a relatively low temperature. For an economic heat balance, the shale leaving the pyrolysis zone is cooled by bottom injected, incoming cool gas. This gas is heated by the hot shale and rises up through the particulate oil shale, through the retorting zone and is subsequently withdrawn as off-gas with the produced pyrolysis products.

Generally speaking, two major processes have been proposed for pyrolysis reaction in the vertical or shaft kiln, the first being a direct combustion process in which residual carbon on the shale is burned in the kiln, producing the heat for the pyrolysis; and the second being an indirect heat retorting in which a non-oxygenous gas is heated externally of the retort and is introduced immediately below the retorting zone, with the incoming heated gas being of a sufficient temperature to produce pyrolysis.

PRIOR ART

In U.S. Pat. No. 3,887,453, patented June 3, 1975, to ueta et al for Process for Obtaining Oil, Gas and By-products from Pyrobituminous Shale or Other Solid Materials Impregnated with Hydrocarbons, there is described an indirect heat source retorting process using Brazilian shells. The composition of the shales is considerably different from Western United States shales so that a large quantity of $H_2S$ gas (some + 25%) is produced. The defined process uses a heated recycle gas (481° - 634° C.) on a weight basis of 1.11 kg of shale to 1 kg of heated gas to a maximum of 1.14 kg of shale to 1 kg of gas. The rate of flow of the gas upwardly through the retort is 0.2 to 5 meters per second.

U.S. Pat. No. 3,922,215 describes a recycle gas process for hydrogenation of oil shale, using a high hydrogen content gas at a high pressure to produce aliphatic and alicyclic hydrocarbon liquids from oil shale. The process is described as using 93.9 mol percent of hydrogen at some 1000 pounds per square inch guage. In this range, some 0.5 mols per hour per 100 pounds of shale per hour were used in the process to make 10.3 pounds of liquid oil per hour.

In U.S. Pat. No. 3,841,992, applicant's previous patent, patented Oct. 15, 1974, for Method of Retorting Hydrocarboneous Solids, there is described a method of using oxygen lean gas with a high $CO_2$ content for the heating gas of a retorting process. This gas is externally heated and introduced into the retort with a water fog, to produce a water-gas shift producing hydrogen and carbon dioxide from the carbon monoxide. The process, also, involves injection of some oxygen into the retort, along with the other gases.

GENERAL DESCRIPTION OF INVENTION

The present invention involves the indirect retorting method in which an externally heated gas provides the heat necessary for the pyrolysis for the oil shale. In this process, a generally non-oxygenous gas (produced by the pyrolysis) is passed at a low temperature into the bottom of the shale bed. The gas cools the hot retorted shale as it passes up the column of the shale. A carefully controlled quantity of a hot, non-oxygenous gas is then introduced into at least one location in the shale bed, generally near the middle point of the kiln to provide a sufficient temperature of the shale for a pyrolysis of the organic carbonaceous material in the oil shale. The resulting gases and shale oil mist pass upwardly through the raw shale fed into the bed, and when disengaged from the shale it is passed out to a shale oil recovery system. With properly controlled parameters, the operational efficiency of the process, on a extended production run, approaches a 100% recovery of shale oil based on the Fischer Assay (F.A.) method of testing of oil shale. The shale oil, gaseous products of the pyrolysis, and other compositions may, likewise, by assayed by the testing method. In general, the shale is sized to a consist of between $+\frac{1}{2}$ to $2\frac{3}{4}$ inches, the quantity of the injected hot gas into the kiln is about 9000–11500 standard cubic feet per ton (SCF/T) of shale and the amount of cooled, monoxygeneous gas is about 9,000 standard cubic feet per ton introduced into the bottom of the shale bed.

OBJECTS OF THE INVENTION

Included among the objects and advantages of the present invention is to provide an efficient commercial process for an indirect mode of retorting oil shale to produce an oil and a high BTU gas, and provide a Fischer Assay recovery of the organic carbon material approaching 100%.

Another object of the invention is to provide a process for retorting oil shale in a vertical column with the heat for the pyrolysis provided by an externally heated gas.

Yet another object of the invention is to provide a process for retorting of oil shale in a single, vertical shaft vessel providing at least three zones in a continuous oil shale bed in the column by the use of indirectly heated gas injected into the bed of shale.

A still further object of the invention is to provide a process for retorting of oil shale in a vertical column which involves injecting heated oil into two levels in a generally upper portion of the column and the injection of cooler gas into the bottom of the column to provide a high efficiency of recovery of the available organic carbon matter of the raw shale.

GENERAL DESCRIPTION OF DRAWINGS

These and other objects and advantages of the invention may be readily ascertained by referring to the following description and appended illustrations in which.

SPECIFIC DESCRIPTION OF INVENTION

Figure 1:
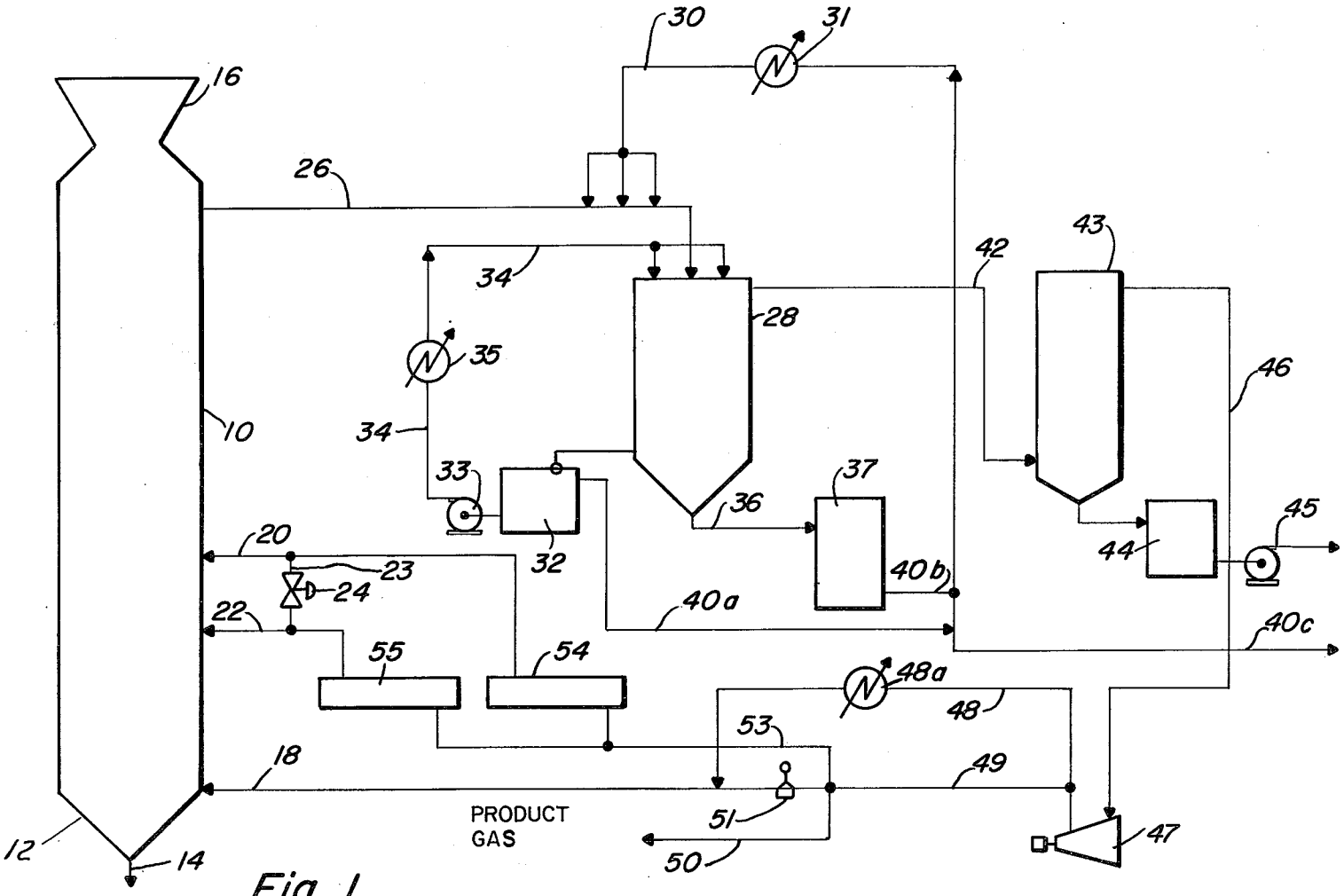
FIG. 1 is a general schematic view of a flow diagram ulitizing the process of the invention for the retorting of oil shale in a single, vertical column.

The indirect mode of retorting, according to the present invention, involves the use of a gas which is externally heated from the kiln, and this heated gas is distributed into the kiln to provide the necessary heat for the pyrolysis of the kerogen in the oil shale. The pyrolysis of the oil shale produces hydrocarbon gas as well as liquid hydrocarbons probably initially formed as vapor and then formed as a mist or the like. It is, therefore, important that the operation be conducted in the absence of oxygen in the gases introduced into the kiln. Additionally the operation of the kiln in an indirect mode tends to produce cracking, coking and a general coalescing of solid material in the retorting zone of the kiln. Such tendencies are reduced by careful control of the operational parameters of the process. In order to effectively initiate the operation of an $8\frac{1}{2}$ foot inside diameter kiln, a startup procedure was devised to prevent any inclusion of oxygenous gas into the kiln, and thereby prevent combustion and/or explosions of the highly flamable gas produced by the retorting.

The parameters of the operation of the kiln include a size consist of shale oil of from about $+\frac{1}{2}$ to $-3$ inches, at a bed depth of about 24 feet to 26 feet, with the shale fed at a rate of from 300 to 600 pounds per square foot per hour. The gas rate into the bed at a 7 foot depth below the surface is at a rate of about 8,000–12,000 SCF/T of shale at a temperature of about 1,000°–1,300° F. The gas velocity in the shale should be less than about 100 feet per second and provide between 380 and 440 million B.T.U. per ton of raw shale. Cooling gas, at a temperature of about 250° F. and in an amount of 600–13,000 SCF/T, is introduced into the bottom of the shale bed.

The startup system involves initially filling the kiln with an inert rock of approximately the same size consist as the shale which would be later fed into the kiln. In this case, the nominal size consist is $\frac{1}{2}$ inch to 2 inch. The retort is filled with lime stone of the nominal size consist, and the lime stone is fed through the top of the kiln at a rate to maintain the desired level in the kiln which may be from 24 to 26 feet in the kiln. The kiln is purged of its oxygen containing gas by an off-gas stream, produced by retorting shale in small kilns. The purging of the large kiln is continued until the oxygen level in the large kiln drops below 2%. After the oxygen content of the kiln is reduced below 2%, hot gas from external heaters is then passed into the bed heating the bed to the retorting temperature of shale, between 900°–1100° F. The gas introduced into the shale enters at about 1000°–1200° F. and when the limestone bed reaches about 900° F. raw shale is then introduced into the top of the bed at the normal rate desired for the particular run. When the retort is completely purged from the limestone by the incoming shale, the heated gas is maintained at a temperature to produce a pyrolysis zone in the shale bed of around 1000°. The off-gas temperature is maintained at about 300°, with the kiln in about a stable operation.

the schematic flow diagram of FIG. 1 shows a general equipment arrangement used for the indirect mode retorting of the present invention, and it includes the use of a vertical kiln 10, shown schematically in cross-section. Normally the vessel will be provided with thermocouple probes extending downwardly for monitoring the temperature of various portions of the shale bed. This is typically a circular vessel, lined with refractory and having a metal skin for containing the refractory and protecting it from injury. The refractory need not be resistant to high heat but should have high insulating material to minimize heat losses. Such a kiln is provided with a grate mechanism in the bottom just above the conical bottom head 12, such grates being well known in the prior art. A very suitable grate is described in U.S. Pat. No. 3,401,922, issued Sept. 17, 1968, for Linear Grate for Shaft Vessels. the retorted shale passes through the grate and out locks, not shown, in the outlet line 14. Such locks are well known in the art and they may be rotary locks, valved locks or the like. Raw shale is introduced by a feed mechanism into the top 16. The shale is generally fed through locks, which are also common in the art, such as rotary feed lock means or the like. Gas for cooling the retorted shale is introduced into the bottom of the kiln 10 through a line 18, an explanation of the cooling gas is given below. The gas for cooling may be introduced by distribution means across the bottom of the column of shale through various means. One effective means as shown in U.S. Pat. No. 3,777,940, patented Dec. 11, 1973, for Bottom Fluid Distributors for Shaft Vessels. Heated gas is introduced into the kiln in one or two levels or locations in the shale bed by means of lines 20 and 22. The injection device may be such as described in U.S. Pat. No. 3,432,348, issued Mar. 11, 1969, entitled Fluid Distributor for Vertical Vessels and also U.S. Pat. No. 3,589,661, issued June 29, 1971 entitled Distributors for Injecting Fluids into Vessels, or such equivalent manifolds and distributors as will provide means for uniformly distributing the gas across the lateral extent of the shale column. The distributors should provide uniform contacting of the particulate solids in the bed with the incoming gas. For large shaft vessels it should be noted that a substantial problem exists in the introduction of gas, and the two patents illustrate effective means for injecting gas into large diameter vessels to provide a uniform flow of the gas across the cross-sectional extent of the vessel. A bypass line 23 provided with a vlave 24 provides means for cross flows of the gas in the lines 20 and 22, if desired. Ordinarily the bypass in closed. Off-gas is removed from the kiln by means of line 26 which, also, includes products of retorting including gases, condensable gases, oil mist or vapor and the like, explained below.

The off-gas, containing the products of the retorting, is passed through a coalescer 28, which is initially provided with a spray of coalescing oil from line 30 injected into line 26 immediately ahead of the coalescer. The coalescing oil through line 30 is at a lower temperature, by a heat exchanger 31, than the material coming from the kiln and, therefore, a substantial quantity of the oil mist is coalesced and recovered in the coalescer 28. To further aid the action of coalescer, some of the oil from the coalescer 28 is collected in a sump 32 and is passed by means of pump 33 to a line 34, through a wash oil heat exchanger 35 into the coalescer. This helps to lower and maintain the temperature of the materials in the coalescer. Recovered oil from the coalescer 28 passes through line 36 into a sump 37 and subsequently out through a product oil ine **40*b*. Oil from sump 32 passes out line 40*a*, joining oil from line 40*b* in product line 40*c*. A spray oil cooler 31 mounted in the line 30 from the product sump 37 provides means for lowering and maintaining the temperature of the spray oil injected into the line 26. The gaseous component not coalesced in the coalescer 28 passes out line 42 into an electrostatic precipitator 43 were the residual oil, shale dust, or any other solids left in the gas are precipitated. With an adequate coalescer the amount of liquid recovered in the electrostatic precipitator should normally be less than about 50%. The liquid from the electrostatic precipitator passes into a sump 44 and subsequently out through line 45, along with the product of line 40*c* to tankage or use. The clean gas from the electrostatic precipitator passes out line 46 through a blower 47. The out line splits the stream into a line 48 passing through a heat exchanger 48*a* and a line 49. The line 49 is, also, split and termimates at one end through a product gas line 50. Line 49, also, feeds cool gas to line 18, being controlled by a valve 51. The gas, not passing out through the product line 50, flows through a line 53 which is split into two parts. One part goes into a heater 54, and the other part goes into a second heater 55, which respectively feeds lines 20 and 22** entering the kiln.

Figure 2:
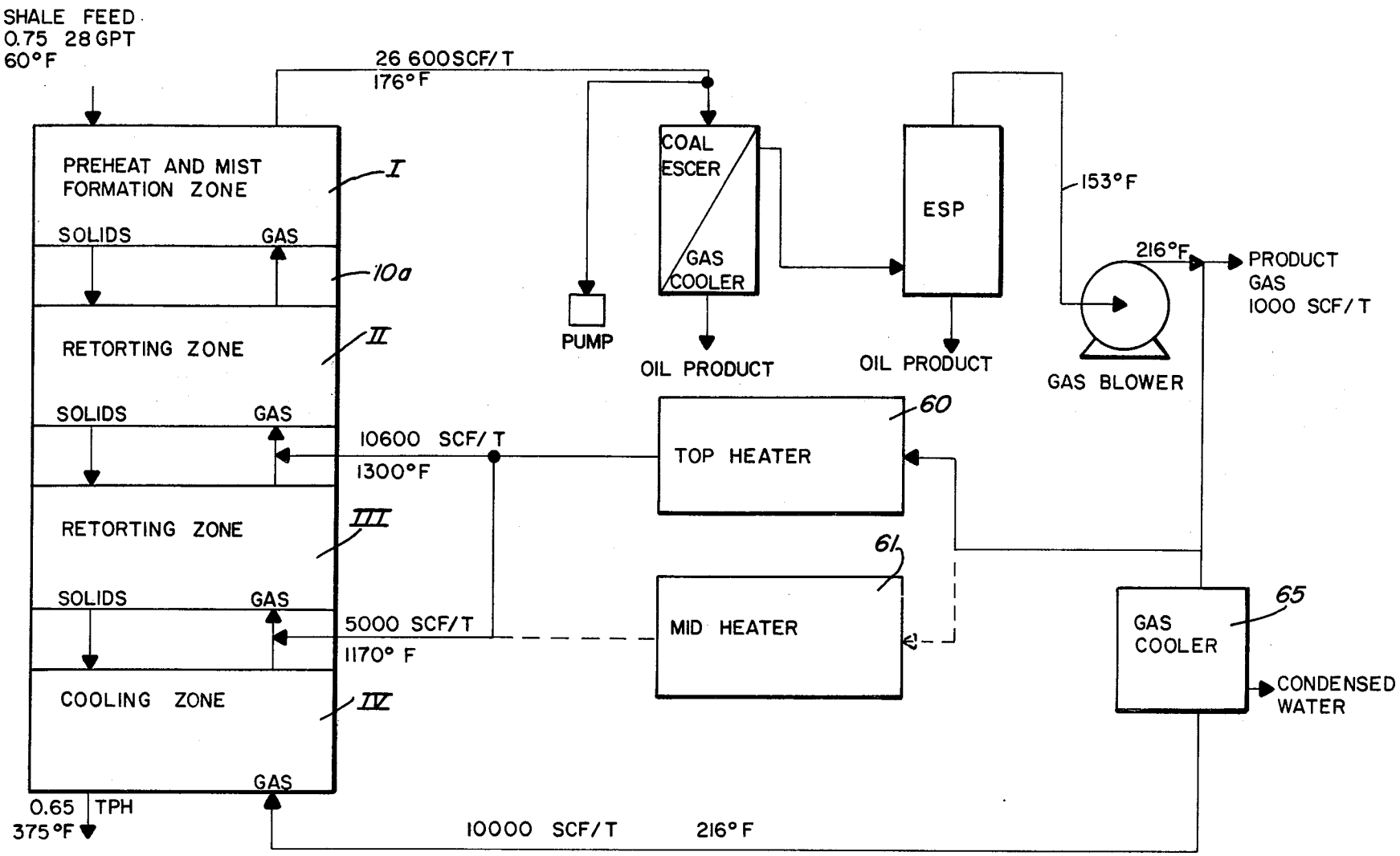
FIG. 2 is a schematic flow diagram of one form of the invention using a double injection of heated gas into a single column of oil shale with the general parameters of the material flows and temperature ranges.

The schematic flow diagram of FIG. 1 essentially provides basis for the diagram of FIG. 2, which shows the rates of the various streams along with their temperatures for a 2 ½ foot kiln. In this indirect mode using an 8 ½ foot inside diameter kiln, providing a shale bed of 24 to 26 feet, shale is fed into the kiln **10*a*** at a rate of 11 tons per hour at about 60° F.

In another test (No. 3) a 2 ½ foot inside diameter kiln was used, with a shale rate of about 0.75 tons per hour. The nominal assay of this shale feed is about 28 gallons per ton of shale containing about 2.5% of water. This shale has a size consist shown in Table 1, below, which is nominally ⅜ to 2 inches. The table is the screen analysis of the shale of the three tests.

TABLE I

| Screen Analysis | Shale Size Consist #1 | #2 | #3 |
|---|---|---|---|
| Size - Inches | Amount 0 Wt % | | |
| 2.00 | 0 | 0 | 0 |
| 1.50 | 20.0 | 25.0 | 10.7 |
| 1.05 | 37.5 | 34.4 | 29.0 |
| 0.742 | 22.3 | 23.2 | 25.7 |
| 0.525 | ·16.0 | 13.9 | 18.0 |
| 0.371 | 1.4 | 1.3 | 2.6 |
| 0.263 | 1.4 | 0.7 | 3.3 |
| 0.185 | 0.4 | 0.4 | 2.6 |
| 0.093 | 0.6 | 0.5 | 4.8 |
| Pan | 0.4 | 1.0 | 2.6 |
| Loss | 0.0 | 0.2 | 0.5 |

This shale passes through the preheat and mist formation zone, I, FIG. 2, into the first or upper retorting zone II, then into a lower retorting zone III and finally through a cooling zone IV and it is discharged from the kiln at about 375° F. The quantity of the retorted shale in the 8 ½ foot diameter kiln is about 9.5 tons per hour with the difference between the retorted shale quantity and the raw shale quantity being withdrawn from the kiln in form of liquid and gas products. The off-gas, which includes recycle gas as well as the products of the retorting including gas and liquid, amounts of about 22,500 standard cubic feet per ton (SCF/T) at about 200°. This passes through the coalescer which recovers about 14 gallons per ton of the oil which is formed as a mist in the retorting. The gas leaving the coalescer passing into the electrostatic precipitator (ESP) which recovers an additional 14 gallons per ton of oil. The gas from the ESP passes into a gas blower which provides about 733 SCF/T product gas at 220° F, a typical gas analysis is shown in Table II.

TABLE II

| | Gas Analysis, Mol. % #1 | #2 | #3 |
|---|---|---|---|
| $H_2$ | 14.1 | 17.06 | 35.0 |
| $N_2$ | .5 | .37 | 0.7 |
| $O_2$ | .1 | 0.0 | 0.1 |

TABLE II-continued

| | Gas Analysis, Mol. % | | |
|---|---|---|---|
| | #1 | #2 | #3 |
| CO | 2.0 | 1.64 | 7.4 |
| $CH_4$ | 10.5 | 17.34 | 11.8 |
| $CO_2$ | 14.7 | 11.19 | 11.7 |
| $C_2H_4$ | 2.5 | 6.41 | 0.8 |
| $C_2H_6$ | 2.7 | 4.91 | 0.6 |
| $C_3$'s | 2.2 | 4.19 | 0.5 |
| $C_4$'s | 0.9 | 1.57 | 0.4 |
| $C_5$'s | 0.3 | .79 | — |
| $H_2S$ | 1.9 | 3.34 | 1.0 |
| $H_2O$ | 45.3 | 29.90 | 30.0 |
| Oil | 0.3 | .50 | — |
| $NH_3$ | 2.0 | .79 | — |
| Total | 100.0 | 100.0 | 100.0 |
| Sp. Gr. | .80 | .78 | .59 |
| Gross H.V. (Wet) | 388 | 676 | 264 |
| Gross H.V. (Dry) | 709 | 964 | 377 |

The remainer of the gas passes a line which is split, one part of 12,750 SCF/T passes into the two heaters 60 and 61, while 9,000 SCF/T at 142° F., after passing a gas cooler 65, is injected into the bottom of the kiln. In the cooling of the gas which enters the cooler at 220° and is exhausted at 142° F., about 4.9 gallons per ton of water is condensed. The gas is split into approximately two equal parts and one-half of each passes through each heater into different levels in the kiln. Thus, about 6,375 SCF/T at about 1200° F. are introduced into the two retorting zones.

In a specific set of tests a single heater (FIG. 3) was used to introduce gas into the 8 ½-foot I.D. kiln, and the schematic flow diagram of the same indicated about 8.5 tons per hour of raw, crushed shale, with a size consist of ½ to 2 inch, at a Fischer Assay of 28 gallons per ton, is passed into the kiln 10*b* and retorted shale is withdrawn from the kiln from about 550° F. In this configuration, about 17,500 SCF/T of gas per ton is passed through the heater 67 and it is introduced into the bed at about 1140° F. About 4,800° SCF/T of gas at 220° F. is passed into the bottom of the kiln to provide cooling for the retorted shale, and to recover some of the sensible heat of the shale for introducing into the retorting zone. The off-gases withdrawn through line 68, in the range of 225°–305° F., pass through the coalescer 69 and the ESP 70, and the final clean gas at about 150° F. is passed into the blower 72 for producing the product gas and the cooling gas. It is noted that in passing through the blower, the gas is heated from 150° to 220° F.

Figure 3:
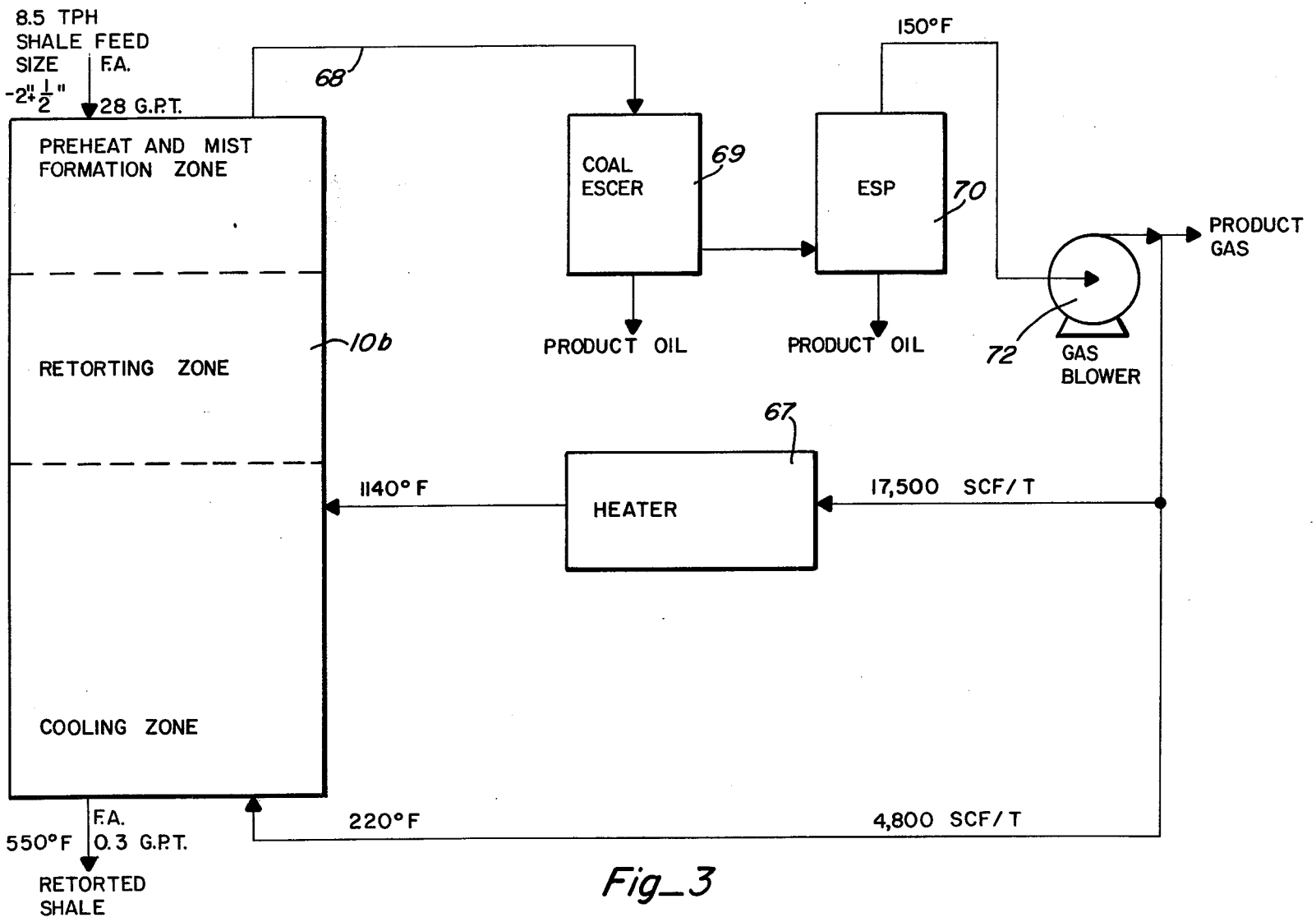
FIG. 3 is a schematic flow diagram of a modified form of the process of the invention illustrating the parameters of the flows and temperature ranges of the mode.

In following the flow diagram of FIG. 3, the following Tables III and IV show the results of two extended runs in the 8 ½-foot I.D. kiln. Another run was made in the 2 ½-foot I.D. kiln. The table sets up the particular length of the test, the rates and quantities of the materials into and out of the kiln. The test are arranged to show the total amount of recycle gas passed into the kiln at 21,101, 24,276 and 32,625 SCF/T. Even through the operating conditions were different for these three tests, the recovered oil in each test was 90 to 92 volume percent based on the Fischer Assay. Addition hydrocarbon is recovered in the product gas, which make the high yield, based on Fischer Assay.

TABLE III

| Test No. | #1 | #2 | #3 |
|---|---|---|---|
| Length, Hours | 100 | 16 | 8 |
| RATES AND QUANTITIES | | | |
| Recycle | | | |
| Top SCF/T | 18,100 | 12,544 | 17,650 |
| Middle SCT/T | 0 | 0 | 4,885 |
| Bottom SCF/T | 6,176 | 8,557 | 10,080 |
| Total SCF/T | 24,276 | 21,101 | 32,625 |
| Raw Shale Tph | 7.9 | 12.3 | .75 |

TABLE III-continued

| Test No. | #1 | #2 | #3 |
|---|---|---|---|
| Length, Hours | 100 | 16 | 8 |
| RAW SHALE PROPERTIES | | | |
| Moisture Content Wt % | 1.27 | .84 | .39 |
| Fischer Assay Gal/Ton | 27.7 | 26.1 | 30.4 |
| F.A. Wt % Oil | 10.55 | 9.94 | 11.6 |
| F.A. Wt % Water | 1.86 | 1.88 | 1.2 |
| F.A. Wt % Gas + Loss | 1.91 | 1.78 | 2.1 |
| Mineral $CO_2$ Wt % | 17.27 | 17.65 | 17.39 |
| Ignition Loss Wt % | 33.23 | 33.25 | 33.68 |
| Carbon Wt % | 17.10 | 17.44 | 18.03 |
| Hydrogen Wt % | 1.77 | 1.83 | 1.93 |
| Nitrogen Wt % | .49 | .48 | .53 |
| Nominal Part, Size In. | ½ × 2 | ½ × 2 | ½ × 2 |
| TEMPERATURES | | | |
| Product Oil Out ° F | 161 | 189 | 153 |
| Retorted Shale Out ° F | 499 | 396 | 375 |
| Raw Shale In ° F | 47 | 50 | 70 |
| Product & Recycle Gas ° F | 216 | 205 | 216 |
| Off-Gas Temperature | 296 | 322 | 176 |
| Top Heater ° F | 1193 | 1242 | 1300 |
| Mid Heater ° F | — | — | 1170 |
| Top Dist. Inlet ° F | 1141 | 1198 | 1290 |
| Mid Dist. Inlet ° F | — | — | 1160 |
| Bottom Dist. Inlet ° F | 216 | 150 | 216 |
| YIELDS | | | |
| Oil Collected Gal/Ton | 25.5 | 24.2 | 27.4 |
| Oil Collected Vol % F.A. | 92 | 92 | 90 |
| Product Gas SCF/Ton | 1552 | 950 | 1040 |
| Retorted Shale Wt % R.S. | 84 | 85 | 86 |
| Liquid Water Lbs/Ton | 17.5 | 37.8 | 5.0 |
| Material Recovery Wt % | 98 | 99 | 98 |
| MISCELLANEOUS | | | |
| Retort dp in $H_2O$/ft. bed | .62 | .82 | .88 |
| Carbonate Decomp. Wt % | 10 | 5 | 5 |
| Retort Bed Height, Ft. In. | 24'0" | 24'0" | 24'4" |
| Throughput, lbs/hr/ft$^2$ | 573 | 463 | 305 |

TABLE IV

| Test No. | 1 | 2 | 3 |
|---|---|---|---|
| PRODUCT OIL PROPERTIES | | | |
| Gravity, Deg. API | 20.3 | 21.0 | 22.8 |
| Viscosity SUS #130° | 110.3 | 85.4 | 92.2 |
| Viscosity SUS 210° | 53.0 | 49.1 | 44.8 |
| Ramsbottom Carbon Wt % | 2.31 | 1.52 | 2.03 |
| Water Content Vol % | 6.84 | 2.77 | 0.1 |
| Solids, BS, Wt % | 1.47 | 1.27 | 0.1 |
| Carbon Wt % | 84.36 | 85.15 | 84.53 |
| Hydrogen Wt % | 11.41 | 11.42 | 11.55 |
| Nitrogen Wt % | 1.92 | 1.99 | 1.72 |
| RETORTED SHALE PROPERTIES | | | |
| Fischer Assay Gal/Ton | 0.3 | 0.6 | 0.1 |
| Mineral $CO_2$ Wt % | 18.63 | 19.82 | 19.14 |
| Organic Carbon Wt % | 2.71 | 3.14 | 2.53 |
| F.A. Wt % Oil | 0.13 | 0.25 | 0.0 |
| F.A. Wt % Water | 0.34 | 0.63 | 0.2 |
| F.A. Wt % Gas + Loss | 0.15 | 0.49 | 0.1 |
| Ignition Loss Wt % | 21.29 | 23.17 | 22.35 |
| Carbon Wt % | 7.78 | 8.55 | 7.78 |
| Hydrogen Wt % | .21 | .34 | .22 |
| Nitrogen Wt % | .27 | .31 | .30 |
| RETORT HEAT REQUIREMENTS | | | |
| Heater Duty, MBTU/T | 498 | 410 | 670 |
| Lbs. Shale/Lb. Hot Gas | 1.81 | 2.66 | 1.97 |

The product gas properties were shown in Table II. The properties of the retorted shale are shown in Table IV, and it can be seen that the shale was completely retorted since only 0.1 to 0.6 gallons per ton were left in the retorted shale. Thermal efficiency of the retort is reflected in the low heater duty in the tests in the larger retort and the high shale to hot gas weight ratio.

Figure 4:
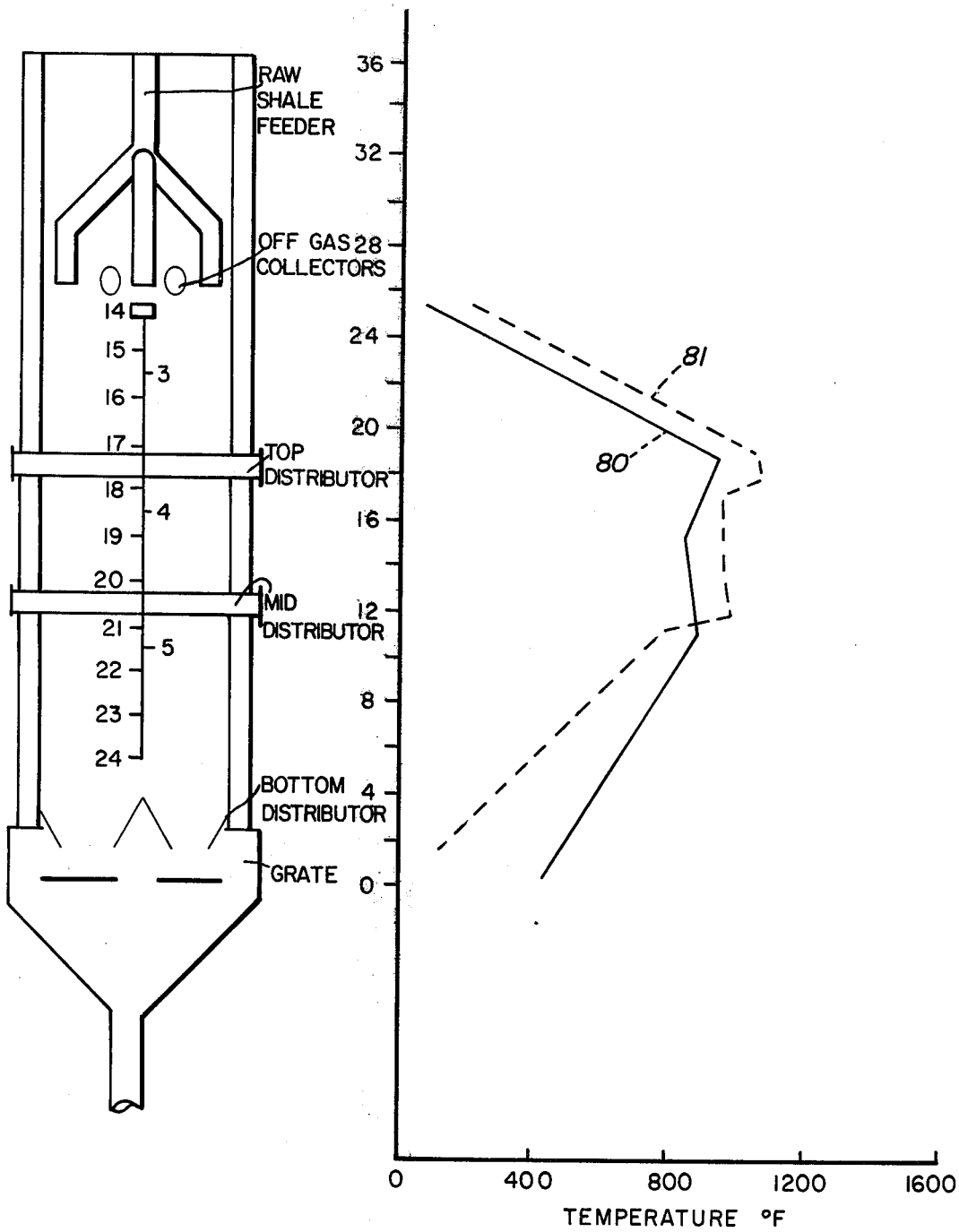
FIG. 4 is a schematic diagram showing a temperature profile in relation to bed height and position of injection of various streams of gas, and the off-gas collector system of the particular mode.

As shown in FIG. 4, two temperature profiles are illustrated in the operation of a kiln having a general configuration as shown of that on the left side of the figure wherein the numbers between the two parts of the diagram show the depth of the bed from the bottom part which is labelled zero up to the depth of the bed between 24 and 26 inches. The solid line 80 demonstrates one mode of operation, wherein the bed temperature, determined by thermocouple probes into the bed, etc., extends from about 900° F. at the lower level to about 950° F. at the upper level. The dash line 81 shows another mode of operation, wherein the temperature at the lower injection level reaches a 1000° F. while the upper level reaches such under 1100° F. As pointed out above, the entering raw shale quickly cools the off-gases and the products of pyrolysis so that they are withdrawn from the top of the kiln at a substantially lower temperature than the retorting temperature while the retorted shale is cooled by the incoming gases and it is withdrawn from the kiln at temperatures substantially below the retorting temperature.

A summary of conditions pertinent to water vapor control for the three test periods is presented in Table V.

TABLE V

| Condition | WATER VAPOR CONTROL #1 | #2 | #3 |
|---|---|---|---|
| Kiln Off-Gas Temperature ° F | 296 | 322 | 176 |
| Recycle Blower Suction Temp. ° F | 154 | 156 | 153 |
| Recycle Blower Discharge Temp. ° F | 216 | 205 | 216 |
| Gas Cooler Discharge Temperature ° F | — | 150 | — |
| Retorted Shale Discharge Temp. ° F | 499 | 396 | 375 |
| Water Vapor in Product Gas in Mol % | 45.3 | 29.9 | 30.0 |
| Water in Oil Pounds per ton raw shale | 15.6 | 5.7 | 5.0 |
| Water Condensed in Cooler lb/ton | — | 32.1 | — |
| Water Vapor in Product gas lb/ton | 33.4 | 13.5 | 14.8 |

In tests #1 and #3, the gas cooler was not in service. In test #3, the spray oil and wash oil systems were not in service. Thus, Table V demonstrates the options of cooling the kiln off-gas to or below its dew point to control the water content of the oil. It, also, demonstrates the option of controlling the water vapor content of the gas to the heaters by cooling sprays for the purpose of minimizing gas cracking in the heaters and transfer lines. This is important at gas heater outlet temperatures above 1200° F. Further, Table V shows the conservation of heat rejected with the retorted shale. Test #2 had 396° F. retorted shale by cooling the bottom gas to 150° compared with Test #1 with 499° F. retorted shale using uncooled bottom gas. In Table IV, test #2 had a heater duty of 410 MBTU/T (million BTU/T) compared with test #1 duty of 498 MBTU/T.

The indirect heating mode of operation of a kiln produces a high BTU gas, with the present process providing a gas about 800 BTU per standard cubic foot, which may be readily upgraded for comingling with conventional pipeline gas. Further, the gas produced by the indirect heating already contains a substantial amount of hydrogen along with hydrocarbon gases. The gas could be processed by conventional means to remove all the components except hydrogen, carbon monoxide, methane, ethane and ethylene and small amounts of propane and propylene. this is a suitable feed for a gas reformer for the production of high purity hydrogen or a 3 to 1 mole ratio of $H_2$ to CO for conversion to substitute natural gas (methane).

The high purity hydrogen (90–95%) could be used to hydrotreat the shale oil to a premium quality synthetic crude as well as to produce anhydrous ammonia.

We claim:

1. A method of retorting oil shale in a closed vertical vessel during an externally heated gas for the pyrolysis of the shale providing an overall efficiency of about 97–100% Fischer Assay recovery of organic carbon comprising:

(a) forming a bed of crushed oil shale in about $a + \frac{1}{2}$ to - 3 inch size consist at a depth of about 24–26 feet ";

(b) feeding ambient temperature crushed shale at a rate of from 300–600 pounds per square foot per hour of cross-section of vessel to the top of the bed and withdrawing retorted shale from the bottom of the bed at a rate to maintain the bed depth;

(c) injecting a first quantity of a non-oxygenous gas into at least one position in said bed at a depth of about 7 feet below the surface of the bed in an amount of about 8,000–12,000 SCF/T at a temperature of about 1,000–1,300° F., said gas being injected in a plurality of jets across the lateral extent of the bed at velocity of less than about 100 feet/sec, and providing from 380 to 440 million BTU per ton of raw shale;

(d) injecting a second quantity of a non-oxygenous cooling gas into the bottom of the bed at temperature of less than about 250° F. and in an amount of 6,000–13,000 SCF/T;

(e) disengaging the resultant products of retorting mixed with the injected gas stream and withdrawing the mixed stream from the vessel.

2. A method according to claim 1, wherein:

the bottom injected gas is at a temperature range of from 140° to 170° F.

3. A method according to claim 1, wherein:

said quantity of heated gas at 1,000°–1,300° F. is split and injected into two levels in said vessel spaced apart vertically and above the cooling zone.

4. A method according to claim 1, wherein:

shale is fed into the vessel at a mass rate of about 455 pounds of shale per square foot of vessel cross-section per hour, about 10,500 SCF/T of non-oxygenous gas at about 1,300° F. is injected into the shale bed, and about 12,000 SCF/T of non-oxygenous cooling gas is injected into the bottom of the shale bed at a temperature of about 150° F.

5. A method according to claim 1, wherein:

the water vapor content of recycled heating and cooling gas is controlled by controlling the temperature of the gas injected into the vessel to provide hot gas with a water vapor content in the range of about 25% at 1,100° F., about 35% at 1,200° F. and about 45% at 1,300° F.

* * * * *